US008673834B2

(12) United States Patent
Trahan

(10) Patent No.: US 8,673,834 B2
(45) Date of Patent: Mar. 18, 2014

(54) METHOD AND COMPOSITION TO REMOVE IRON AND IRON SULFIDE COMPOUNDS FROM PIPELINE NETWORKS

(76) Inventor: David O. Trahan, Lafayette, LA (US)

( * ) Notice: Subject to any disclaimer, the term of this patent is extended or adjusted under 35 U.S.C. 154(b) by 718 days.

(21) Appl. No.: 12/928,777

(22) Filed: Dec. 17, 2010

(65) Prior Publication Data

US 2011/0152153 A1 Jun. 23, 2011

Related U.S. Application Data

(63) Continuation of application No. 12/288,149, filed on Oct. 16, 2008, now Pat. No. 7,855,171.

(51) Int. Cl.
*C11D 7/36* (2006.01)
*C11D 3/30* (2006.01)

(52) U.S. Cl.
USPC ..... 510/188; 510/222; 510/228; 510/247; 510/288; 510/363; 510/401; 510/431; 510/435; 510/436; 510/467; 510/480

(58) Field of Classification Search
USPC ..... 510/188, 222, 247, 228, 288, 363, 401, 510/431, 435, 436, 467, 480
See application file for complete search history.

(56) References Cited

U.S. PATENT DOCUMENTS 6,517,617 B1 * 2/2003 Chartier et al. ..... 106/14.42
2012/0097392 A1 * 4/2012 Reyes et al. ..... 166/279

* cited by examiner

*Primary Examiner* — Charles Boyer

(57) ABSTRACT

The present invention comprises an iron complexing mixture and method of using same wherein beneficial performance and natural gas pipeline cleaning methods are employed. The synergistic improvement of combining two water-soluble metal complexing agents, THPS and IDS, prove to offer advantages in performance over the individual use of either chemical.

9 Claims, 2 Drawing Sheets

METHOD AND COMPOSITION TO REMOVE IRON AND IRON SULFIDE COMPOUNDS FROM PIPELINE NETWORKS

CROSS-REFERENCE TO RELATED APPLICATIONS

This application is a continuation application of U.S. patent application Ser. No. 12/288,149, filed on Oct. 16, 2008 now U.S. Pat. No. 7,855,171.

FIELD OF THE DISCLOSURE

The present disclosure relates to the use of chemical compounds to decrease and remove iron compounds, including iron sulfide, from pipeline networks.

BACKGROUND OF THE DISCLOSURE

Iron compounds, including iron sulfide can form within pipeline networks that transport gas, oil, water and mixtures of gas, oil and water. The iron sulfide compounds are physically characterized as appearing to be amorphous solid particles capable of absorbing water and oil.

Hydrogen sulfide, $H_2S$, is a naturally occurring contaminant of fluids that is encountered in many industries, including the oil and gas industry and the paper industry. The corrosive nature of $H_2S$ causes the accumulation of particulate iron sulfide. Iron sulfide becomes entrained in hydrocarbons, glycol, salts, and the like to form deposits on the surfaces of conduits such as pipelines. Such deposits present a significant problem because the deposits hinder accurate determinations of pipeline structural integrity and the pipelines must be cleaned physically.

Given the various chemical and physical conditions that go into the forming of iron sulfide several forms can be found in a given section of pipeline. It is seldom that a single type of iron sulfide exists but more generally it is a mixture of iron sulfide with mackinawite being the most dominant species present. Other species of iron sulfide commonly found in pipeline networks include: marcasite, pyrite, pyrrhotite, troilite and magnetite. The chemical formula for iron sulfide is commonly shown as FeS, which is the chemical formula for troilite. However depending upon the degree of oxidation and exposure to hydrogen sulfide gas, oxygen and other various physical elements it can include: $Fe_9S_8$ (mackinawite), $FeS_2$ (Marcasite), $FeS_2$ (Pyrite), $Fe_7S_8$ (Pyrrhotite).

The iron sulfide particles can adhere to the internal surfaces of pipeline networks and associated process equipment. The physical characteristic of the iron sulfide deposits can vary from a viscous, oil coated mass to a dry black powder form. The buildup of iron and iron sulfide deposits over time can lead to a range of operational problems. The presence of iron and iron sulfide deposits can lead to increased corrosion rates within pipeline networks. It can also lead to interference in the safe operation of pipeline valving systems, potentially leading to catastrophic system failures. Therefore, the cleaning of pipeline networks containing iron and iron sulfide deposits is a common practice within the pipeline industry.

In the oil industry, these ferrous deposits are a major source of economic loss. The deposits obstruct the flow of oil in wells, in the adjacent strata and in pipelines as well as in processing and refinery plants. Further such deposits tend to stabilize oil-water emulsions that tend to form during secondary oil recovery. Generally, the deposits present major problems to oil producers.

Many different methods for cleaning pipeline networks have developed over time. The cleaning methods used to decrease and remove the iron and iron sulfide deposits include mechanical pigging, batch chemical cleaning, and continuous chemical cleaning. The chemical compounds used in batch and in continuous cleaning methods includes chemicals based totally or in part upon: surfactants, solvents, acids, bases, oxidizing agents, chelating agents and combinations of these.

Using a strong acid is the simplest way to dissolve such a deposit. But using a strong acid generates large volumes of highly toxic $H_2S$ gas, which is an undesirable by-product. Using an oxidizing agent may avoid such toxicity hazards but produces oxidation products, including elemental sulphur which is corrosive to pipes. Another agent for treating such deposits is acrolein, but it also has health, safety and environmental problems.

It has been found that tris (hydroxymethyl) phosphine (referred to herein as THP and may be referred to elsewhere as THP or TRIS) is capable of solubilizing iron and iron sulfide by forming a THP Iron Ammonium complex that is water soluble. The water soluble THP Iron Ammonium complex is characteristically a red liquid solution. The THP is believed to be formed from the addition of Tetrakis(hydroxymethyl) phosphonium salts (referred to herein as THPS or THP Salts) especially the sulfate salt. THPS is commonly used as a flame retardant for textiles and also is added to oil wells, gas pipelines and water injection systems to reduce the interference of iron and iron sulfide. THPS is also recognized as an effective chemical to control the presence of sulfate reducing bacteria (referred to herein as SRB) and is regularly supplied as a biocide. A biocide is a chemical substance capable of killing living organisms, usually in a selective way. Biocides are commonly used in medicine, agriculture, forestry, and in where they prevent the fouling of water and oil pipelines. The presence of SRBs in part causes the presence of iron sulfide compounds in pipeline networks. It has been found that the effectiveness of THP salts in the removal of iron and iron sulfide compounds is not always at acceptable levels. This is believed to be due to the inconsistent composition of the iron and iron sulfide compounds as they exist within the pipe networks along with the ability to properly distribute the THP salts within the pipeline network.

Thus, tris (hydroxymethyl) phosphine (THP) is capable of solubilizing iron sulfide by forming a bright red water-soluble complex. THP is formed in oil wells treated with tetrakis (hydroxmethyl) phosphonium salts (THPS). THPS is commonly added to oil wells as a biocide to kill the sulfate reducing bacteria. Unfortunately, the effectiveness of THP as a solubilizing agent for iron sulfide varies considerably from well to well because the complex with iron sulfide requires the presence of ammonium ions. The concentration of ammonium ions in oil field water is frequently less than the optimum for iron sulfide removal. THP and THPS have stability problems at higher pH values. The use of THP with ammonia is hindered by the tendency of THP and ammonia to react together to form an insoluble polymer. The formulation of THP and ammonia is only fully stable at a pH below 4, and polymerization is rapid at any pH greater than 6, but the complex only forms readily at a pH above 5. If the ammonia concentration is high there is a risk of polymer depositing in the formation and obstructing the flow of oil or water. For all the foregoing reasons it is difficult to obtain consistent performance in preventing or removing iron sulphide scale using THP.

Phosphines are a class of compounds. Phosphines are alkyl or aryl derivatives of phosphine, just as amines can be regarded as derivatives of ammonia. Common examples include triphenylphosphine ($(C_6H_5)_3P$) and BINAP, both used as phosphine ligands in metal complexes such as Wilkinson's catalyst. Metal phosphine complexes are catalysts for reactions such as the Sonogashira coupling. Most of these phosphines, with the exception of triphenyl phosphine, are made from pressurized, purified phosphine gas. A large industrial application of phosphine is found in the production of tetrakis(hydroxymethyl) phosphonium salts, made by passing phosphine gas through a solution of formaldehyde and a mineral acid such as hydrochloric acid. These salts find application as flame retardants for textile (Proban®—registered trademark of Rhodia UK Limited) and as biocides.

In a paper published in the Royal Society of Chemistry in 2000, entitled: "Self assembly of a novel water soluble iron (II) macrocyclic phosphine complex from tetrakis(hydroxymethyl) phosphonium sulfate and iron (II) ammonium sulfate: single crystal X-ray structure of the complex," authors, John C. Jeffery, Barbara Odell, Nicola Stevens and Robert Talbot describe the mechanism by which a water soluble transition metal complex is formed. This paper was accepted for publication on Dec. 6, 1999. In this paper, the authors describe a series of reactions that lead to a situation where THPS aids in the dissolution of iron sulfide in oil fields leading to a red coloration of the treated water. The authors describe how the speciation of the iron sulfide (FeS) system in natural environments, such as oil wells, is necessarily complex. Further, their model reactions allow us to tentatively propose THPS and ammonia ($NH_4^+$) ions self assemble iron complexes where the iron originates from iron sulfide formed in oil wells owing to sulfate reducing bacteria or indigenous $H_2S$.

A paper presented in 1998 in Mexico City referenced the use of THPS as an iron-sulfide dissolving agent. "Tetrakis (hydroxymethyl)phosphonium sulfate (THPS), A New Oilfield Bactericide Providing Iron Sulfide Dissolution and Environmental Benefits," was presented by T. Haack, R. Diaz and R. E. Talbot, at Exitep 98, Mexico City, 15-16 Nov. 1998. In this paper, the authors noted in actual field conditions the use of THPS as a bactericide in pipelines also demonstrated the reduction in iron sulfide deposits. Therefore, it has been well established by those skilled in the art that THPS with ammonium salts is effective at dissolving iron sulfide deposits.

A feature of the present disclosure is to provide a composition for removing iron and iron sulfide solids from within pipeline networks.

Another feature of the present disclosure is to provide a composition that forms a water-soluble complex with the iron and iron sulfide solids.

Another feature of the present disclosure is to provide a composition for removing iron and iron sulfide solids in either batch or continuous applications.

A feature of the present disclosure is to provide a method for removing iron and iron sulfide solids from within pipeline networks.

Another feature of the present disclosure is to provide a method that forms a water-soluble complex with the iron and iron sulfide solids.

Another feature of the present disclosure is to provide a method for removing iron and iron sulfide solids in either batch or continuous applications.

A feature of the present disclosure is to provide a composition and method for forming a water-soluble complex with the iron and iron sulfide solids.

Another feature of the present disclosure is to provide a composition and method for removing iron and iron sulfide solids using a unique blend of metal complexing agents.

Yet another feature of the present disclosure is to provide a composition and method for removing iron and iron sulfide solids using a synergistic mixture of IDS or IDS salts and THP or THP salts.

Yet still another feature of the present disclosure is to provide a composition and method for removing iron and iron sulfide solids using a synergistic mixture of IDS, THP, water soluble surfactants, corrosion inhibitors, defoamers and pH buffering agents.

A feature of the present disclosure is to provide a composition and method for removing iron and iron sulfide solids with a non-toxic, metal complexing agent.

Another feature of the present disclosure is to provide a composition and method for removing iron and iron sulfide solids to create water-soluble complexes with iron solids within pipeline networks.

Yet another feature of the present disclosure is to provide a composition and method for removing iron and iron sulfide solids using environmentally friendly chelating agents.

Yet still another feature of the present disclosure is to provide a composition and method for removing iron and iron sulfide solids by disrupting the solid matrix of the iron and iron sulfide solids resulting in a dispersion of solids into the liquid phase.

Another feature of the present disclosure is to provide a composition and method for removing iron and iron sulfide solids by forming soluble complexes of iron that can be removed in the cleaning process.

Another feature of the present disclosure is to provide a composition and method for removing iron and iron sulfide solids by synergistically combining iron complexing agents.

Additional features and advantages of the invention will be set forth in part in the description which follows, and in part will become apparent from the description, or may be learned by practice of the invention. The features and advantages of the invention may be realized by means of the combinations and steps particularly pointed out in the appended claims.

SUMMARY OF THE INVENTION

To achieve the foregoing objects, features, and advantages and in accordance with the purpose of the invention as embodied and broadly described herein, a composition and method to decrease or remove iron compounds, including iron sulfide, from pipeline networks is provided.

The present invention provides a much-improved chemical composition over current chemical technologies capable of removing iron and iron sulfide solids from within pipeline networks by forming a water-soluble complex with the iron and iron sulfide solids. The chemical composition of this invention is capable of removing iron and iron sulfide solids in either batch or continuous applications.

This method involves adding to the pipeline network in a batch or continuous manner a mixture of chemical compounds combined into a single liquid product comprising: (1) iminodisuccinic acid ("IDS"); (2) tetrakis(hydroxymethyl) phosphonium sulfate ("TRPS"); (3) a surface tension reducing water soluble surfactant; (4) a water-soluble corrosion inhibitor; (5) a defoamer; (6) a water soluble ammonium salt; and (7) a pH buffering chemical. The present invention comprises of a pipeline cleaning compound which is capable of removing iron and iron sulfide solids from pipeline networks.

While pipeline-cleaning products, based upon THPS in whole or in combination with other metal chelating chemical products, have been used in the pipeline industry in the past, their use in combination with Iminodisuccinic acid has not been appreciated by those skilled in the art. Further the use of a sodium, potassium or amine salt of Iminodisuccinic acid in combination with THPS has not been appreciated by those skilled in the art.

Additional advantages and modification will readily occur to those skilled in the art. The invention in its broader aspects is therefore not limited to the specific details, representative apparatus, and the illustrative examples shown and described herein. Accordingly, the departures may be made from the details without departing from the spirit or scope of the disclosed general inventive concept.

BRIEF DESCRIPTION OF THE DRAWINGS

The accompanying drawings which are incorporated in and constitute a part of the specification, illustrate preferred embodiments of the invention and together with the general description of the invention given above and the detailed description of the preferred embodiment given below, serve to explain the principles of the invention.

Figure 1:
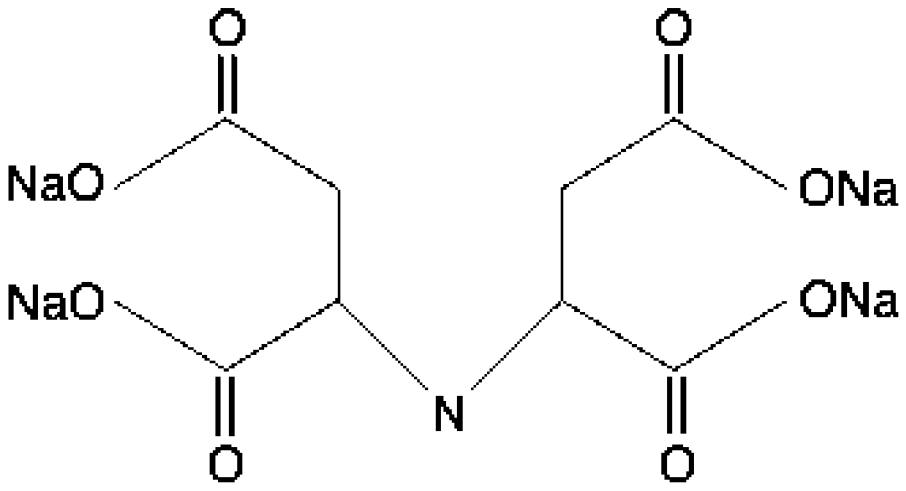
FIG. 1 shows the chemical structure of N-(1,2 dicarboxyethyl)-tetrasodium salt.
Figure 2:
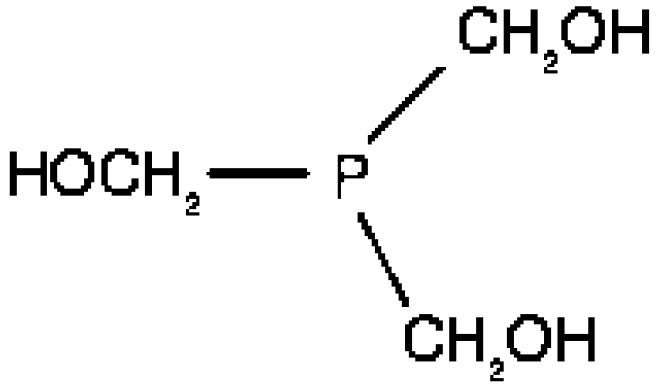
FIG. 2 shows the chemical structure of THP, tris (hydroxymethyl) phosphine.
Figure 3:
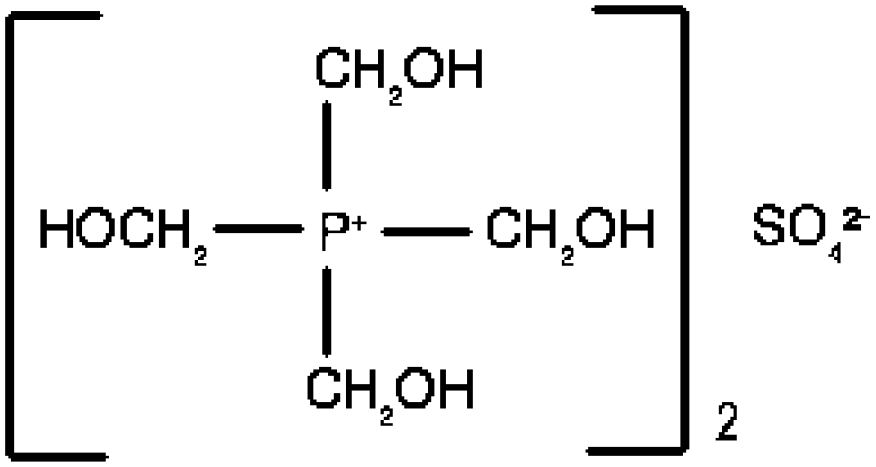
FIG. 3 shows the chemical structure of THPS; tetrakis (hydroxymethyl) phosphonium sulfate.

The above general description and the following detailed description are merely illustrative of the generic invention, and additional modes, advantages, and particulars of this invention will be readily suggested to those skilled in the art without departing from the spirit and scope of the invention.

DETAILED DESCRIPTION OF THE PREFERRED EMBODIMENTS

Reference will now be made in detail to the present preferred embodiments of the invention as described in the accompanying drawings.

As identified above, there exists a long-standing problem of removing iron and iron sulfide solids from pipeline networks. As discussed above, there have been many efforts and trials to solve the problem of removing iron or iron sulfide solids from pipeline networks resulting in failures or, at best, limited success.

The present invention provides the use of a synergistic mixture of IDS and THP or THP salts along with water soluble surfactants, corrosion inhibitors, defoamers and pH buffering agents to reduce and remove iron and iron sulfide compounds within pipeline networks when used continuously or in batch application methods.

The iron deposit and iron sulfide cleaning product functions by a complex mechanism to dissolve iron. The product of this invention contains a unique blend of metal complexing agents along with other functional additives to improve the performance. Preferably the chemical mixture incorporates a non-toxic, metal complexing agent to create water-soluble complexes with iron solids within pipeline networks. Once complexed into water-soluble complexes, the iron and iron sulfide solids are removed from the pipeline network along with water. The iron complexing chemical may be selected from, but it not limited to, a group of iron chelating compounds including polyaspartates; hydroxyaminocarboxylic acid (HACA); hydroxyethyliminodiacetic (HEIDA); iminodisuccinic acid (IDS); ethylene diaminetetracetic acid (EDTA); diethylenetriaminepentaacetic acid (DTPA); nitrilotriacetic acid (NTA), tetrakis(hydroxymethyl)phosphonium sulfate (THPS); and other carboxylic acids and their salt forms, phosphonates, acrylates, and acrylamides, and mixtures thereof.

The present invention provides for an iron and iron sulfide complexing chemical that comprises a blend of two or more iron complexing agents. The preferred iron and iron complexing agents consisting of iminodisuccinic acid (IDS) and salts of IDS, and tetrakis (hydroxymethyl) phosphonium sulfate (THPS). Both IDS (and IDS salts) and THPS singularly have the ability to complex iron compounds to varying levels. However, when synergistically combined at various proportions with each other, the overall effectiveness of the iron solubilization capacity is increased many times over the individual capacity of IDS or THPS. It has been observed that the two preferred iron and iron complexing agents have a synergistic effect whereby each improves the ability of the other to increase the ability to complex and form water-soluble complexes of iron and iron sulfide solids. Both IDS and THPS represent environmentally friendly chelating agents.

It has been observed that the overall performance of the iron complexing agents individually and when combined together at various ratios improve at alkaline pH values. The pH of the mixture can be adjusted into the alkaline range using ammonium hydroxide, ammonium chloride, ammonium citrate, ammonium lactate, ammonium acetate, potassium citrate, potassium hydroxide, potassium formate, sodium hydroxide, sodium acetate, or sodium formate. In the alkaline range many metal ions form hydro-complexes that influence the concentration of metal ions. As a result, the conditional complexing constants have a more or less pronounced maximum, which depends on the pH. Metal ions other than iron can form soluble complexes and be removed in the cleaning process. This aids in the overall disruption of a solid matrix resulting in a dispersion of solids into the liquid phase of the pipeline network. The presence of a surfactant aids in the dispersion and avoids deposits from reforming at downstream points within the pipeline network.

The iminodisuccinic acid (IDS) readily acts as a pentadentate N,O donor ligand in its coordination to metal ions. The location of the five donor atoms in the molecule is such that the formation of mono complexes is likely to prevail in the solutions. The preferred embodiment iminodisuccinic acid (IDS), commercially supplied as Baypure CX100 is produced from maleic anhydride, water, caustic soda and ammonia, and has the chemical formula: $C_8H_7NO_8Na_4$.

The improved effectiveness of dissolving iron sulfide by combining IDS with THPS was determined by visually observing a much darker red coloration within test bottles containing iron sulfide plus THPS alone and iron sulfide plus a blend of IDS and THPS. Along with the observation of a rapid red coloration analytical tests determined that iron sulfide samples exposed to the combination of IDS and THPS. The following table was created by mixing 1 gram (accurately weighed) of a lab grade supply of iron sulfide into 100 grams of water containing the reported concentrations of THPS, IDS, Potassium hydroxide (45% aq), Ammonium chloride, C-Pro 231. The samples were stirred for 1 minute so as to fully incorporate the iron sulfide powder into the liquid, and then were allowed to rest at room temperature for 24 hours. The samples were then filtered to draw a representative volume and dissolved iron values were measured using an inductively coupled plasma arc spectrophotometer (ICP).

| Exp. Set | Water Wgt % | THPS Wgt % | Potassium hydroxide 45% aqueous Wgt % | Ammonium chloride Wgt % | C-Pro 231 Corrosion Inhibitor Wgt % | IDS 34% aqueous Wgt % | Dissolved Iron ppm |
|---|---|---|---|---|---|---|---|
| 1 | 93.6 | 3.5 | 1.4 | 0.1 | 1 | 0 | 843 |
| 2 | 88.5 | 7 | 1.4 | 0.1 | 1 | 0 | 821 |
| 3 | 78.5 | 14 | 1.4 | 0.1 | 1 | 0 | 978 |
| 4 | 68.5 | 21 | 1.4 | 0.1 | 1 | 0 | 1231 |
| 5 | 93.6 | 3.5 | 1.4 | 0.1 | 1 | 11 | 758 |
| 6 | 88.5 | 7 | 1.4 | 0.1 | 1 | 22 | 1461 |
| 7 | 78.5 | 14 | 1.4 | 0.1 | 1 | 44 | 1482 |
| 8 | 68.5 | 21 | 1.4 | 0.1 | 1 | 65 | 1836 |
| 9 | 93.6 | 3.5 | 1.4 | 0.1 | 1 | 5 | 1593 |
| 10 | 88.5 | 7 | 1.4 | 0.1 | 1 | 10 | 1601 |
| 11 | 78.5 | 14 | 1.4 | 0.1 | 1 | 20 | 1804 |
| 12 | 68.5 | 31 | 1.4 | 0.1 | 1 | 30 | 1760 |

In the table above, tests show a dramatic increase in the dissolved iron in the water when both THPS and IDS are used in combination. Comparing Exp. Set. No. 2 (THPS without IDS) versus Exp. Set. No. 10 (THPS plus IDS) the addition of IDS resulted in a 95% increase in the amount of dissolved iron. The ratio of THPS to IDS in this example is 1 part THPS to 1.428 parts IDS. The table above shows an increase in the dissolved iron at ratios as high as 1 part THPS to 3.142 parts IDS. The trend of this increase indicates that the ratio range from 0.5 part THPS to 1 part THPS mixed with 1 part IDS to 5 parts IDS to increase the solubility of iron in water greater than the use of THPS alone.

Field observations of the effect of mixtures that combine THPS and IDS indicate that the mixture of THPS and IDS create an immediate red coloration of the water indicating the immediate increase in iron. So in addition to increasing the concentration of iron in the water when mixtures of THPS and IDS are used, the speed in the reaction is greatly increased. THPS alone in the water requires several hours, and in some field samples days of exposure to display a slight red coloration in the water. When the same sample of iron sulfide is exposed to the same concentration of a mixture of THPS and IDS the red coloration appears in less than one minute. This confirms the speed of reaction improvement.

While several experimental blends combining THPS and IDS along with other functional additives to enhance the application, the following proved to be an optimum blend that provided fast reaction time, higher concentrations of dissolved iron and economical when compared with other treatment products designed to accomplish the same task. It was found that the following represents a preferred blend for a commercial product:

Formula 1

| Ingredient | Percentage by Weight (wgt %) |
|---|---|
| Water | 75.4 |
| Scale Inhibitor | 1.0 |
| IDS (34% aqueous) | 7.0 |
| THPS (70% aqueous) | 3.0 |
| Surfactant | 3.0 |
| Ammonium chloride | 0.1 |
| C-Pro 231 | 0.1 |
| Propylene glycol | 12.0 |
| Sodium hydroxide (50% aqueous) | 0.3 |
| Green Dye | 0.3 |

In Formula 1, the sodium hydroxide is adjusted so as to create a pH in the mixture of between 6.0 to 7.0, so the amount listed in Formula 1 is an average point of addition. If more or less is required the volume of water is adjusted so as to maintain concentrations of other ingredients. The following ingredients are added as functional additives to improve the effectiveness of the THPS/IDS mixture. The scale inhibitor is selected from a group of scale inhibitors which includes acrylic polymers, co-polymers and terpolymers, phosphonates, phosphinocarboxyates, and phosphate esters. The preferred scale inhibitor in this formulation is Biolab Bellasol S-60, described as an aqueous solution of polycarboxylic acids. The surfactant is selected from a group of ethoxylated alcohols, nonyl phenol ethoxylates, dioctyl esters of sulfosuccinates. The preferred surfactant in the Formula 1 is Harcros T-Det A267 NR, described as a C10-C16 ethoxylated alcohol. C-Pro 231 is a proprietary blend of carboxylic acids salted with an amine creating a corrosion inhibitor. Other water soluble inhibitors that can be used include: imidazolines, alkyl pyridine quats, thio amines, phosphate esters.

The methods of applying the composition of this invention are broadly applicable to pipe systems, vessels, filters, filter separators, gas meter equipment that are contaminated with or measure the presence of iron sulfide deposits. The pipe systems include vessels that carry water, gas, or other fluids. The natural gas pipe systems may contain dry gas, as defined by the oil and gas industry as containing less than 7 pounds of water per 1 million standard cubic feet of natural gas, or contain moisture at volumes above dry gas standard. The natural gas pipe systems may contain gas condensate, oil or other finished petroleum products. A particular advantage of the invention is that it provides a quick dissolution of iron sulfide deposits which are dissolved in a water phase that is heavier than oil fraction and easily separated in downstream separation equipment. Removing the iron sulfide from natural gas pipelines upstream of gas filter separators will decrease the filter change interval, reducing the cost of operations and the volume of waste the pipeline operator is required to properly dispose.

The composition of this invention can be introduced into natural gas pipeline systems by any means, or combination of means, necessary to bring the compositions into direct contact with iron sulfide deposits. The compositions can be introduced by continuous or intermittent injection, and by periodic batch volume injection. The use of continuous injection or intermittent injection is more acceptable for online cleaning applications. In online cleaning applications the flow of natural gas in the pipeline is not interrupted in any way, allowing for normal gas delivery operations to occur while simultaneously cleaning iron sulfide deposits. Alternatively, a batch injection of the compositions can be used where iron sulfide deposits are removed using pipeline pigging methods. Batch injection of composition is effective when a volume of the composition is injected ahead of and in conjunction with pipeline pigging operations. The volume of iron complexing compositions is dependent upon the size and length of the pipeline along with consideration for the suspected volume of iron sulfide present within the section to be treated. In batch pigging operations the natural gas pipeline is taken off line.

While any amount of composition of this invention applied into a natural gas pipeline or associated vessels will create iron dissolution effects, the actual pipeline condition will direct the application volume and method. Continuous, intermittent or batch may be used separately or in concert with each other to effect an adequate cleaning of the pipeline network.

Although the present invention has been described and illustrated with respect to preferred embodiments and a preferred use thereof, it is not to be so limited since modifications and changes can be made therein which are within the full scope of the invention.

Additional advantages and modification will readily occur to those skilled in the art. The invention in its broader aspects is therefore not limited to the specific details, representative apparatus, and the illustrative examples shown and described herein. Accordingly, the departures may be made from the details without departing from the spirit or scope of the disclosed general inventive concept.

What is claimed is:

1. A composition for cleaning pipelines transporting natural gas to remove deposits of iron sulfide by forming water-soluble iron complexes with the iron fraction of the iron sulfide, the composition comprising at least (a) tetrakis (hydroxymethyl) phosphonium sulfate, and (b) iminodisuccinic acid sodium salt.

2. The composition defined in claim 1 wherein the tetrakis (hydroxymethyl)phosphonium sulfate is present in an amount of from 3 wt % to 20 wt %.

3. The composition defined in claim 1 wherein the iminodisuccinic acid sodium salt is present in an amount of from 3 wt % to 30 wt %.

4. The composition defined in claim 1 further comprising water.

5. The composition defined in claim 4 wherein the water is present in an amount of from 35 wt % to 95 wt %.

6. The composition defined in claim 1 further comprising a soluble ammonium salt.

7. The composition defined in claim 6 wherein the soluble ammonium salt is present in an amount of from 0.1 wt % to 5 wt %.

8. The composition defined in claim 1 further comprising sodium hydroxide.

9. The composition defined in claim 8 wherein the sodium hydroxide is present in an amount of from 0.1 wt % to 3 wt %.

* * * * *